US006506019B2

(12) United States Patent
Lin et al.

(10) Patent No.: US 6,506,019 B2
(45) Date of Patent: Jan. 14, 2003

(54) BOAT PROPELLER CAPABLE OF BEING EASILY CHANGED IN PITCH THEREOF

(75) Inventors: Yeun-Junn Lin, Taichung (TW); Chih-Chiang Tsai, Taichung (TW); Hui-Jeng Lin, Taipei (TW); Ya-Jung Lee, Taipei (TW)

(73) Assignee: Solas Science & Engineering Co., Ltd., Taichung (TW)

( * ) Notice: Subject to any disclaimer, the term of this patent is extended or adjusted under 35 U.S.C. 154(b) by 44 days.

(21) Appl. No.: 09/865,550

(22) Filed: May 29, 2001

(65) Prior Publication Data

US 2002/0182080 A1 Dec. 5, 2002

(51) Int. Cl.[7] ..... B63H 3/12

(52) U.S. Cl. ..... 416/93 A; 416/244 B; 416/214 R; 416/219 R

(58) Field of Search ..... 416/93 A, 244 B, 416/214 R, 220 R, 220 A, 219 R; 440/49, 50

(56) References Cited

U.S. PATENT DOCUMENTS 3,403,735 A * 10/1968 Langhjelm et al. ..... 416/140
4,419,052 A * 12/1983 Stamm ..... 416/214 A
4,930,987 A * 6/1990 Stahl ..... 416/219 A
6,312,223 B1 * 11/2001 Samuelsson ..... 416/132 R

* cited by examiner

*Primary Examiner*—Edward K. Look
*Assistant Examiner*—Igor Kershteyn
(74) *Attorney, Agent, or Firm*—Browdy and Neimark

(57) ABSTRACT

A boat propeller comprises a hub formed of a front cylindrical member and a rear cylindrical member. The hub is provided in the joining place with a plurality of receiving cavities which are arranged equiangularly and circularly. Each cavity is provided removably with an angle setting member which is joined with the hub. A plurality of blades are joined with the outer periphery of the hub such that the inner ends of the blades are inserted into the cavities and are located by the angle setting members. Under the circumstance that the shapes of the hub and the blades remain unchanged, the blade pitch in relation to the hub can be changed by the angle setting members of various shapes.

5 Claims, 6 Drawing Sheets

BOAT PROPELLER CAPABLE OF BEING EASILY CHANGED IN PITCH THEREOF

FIELD OF THE INVENTION

The present invention relates generally to a boat propeller, and more particularly to a boat propeller which can be easily changed in its pitch.

BACKGROUND OF THE INVENTION

The propeller pitch refers to an angle formed between a blade chord line in any radial position and a plane of rotation. In other words, the propeller pitch refers to an inclination of the propeller blade surface. The blade angle determines the performance of the propeller. Accordingly, the propellers are made to be different in pitch, depending on the type and the purpose of the propellers.

The propellers were used to be made integrally. As a result, various molding tools were used to make the propellers different in pitch, thereby resulting in the high cost of producing the propellers.

The boat propeller pitch affects the cruising speed, the thrust, and the fuel efficiency of the boat. For this reason, the small boat is provided by its operator with a propeller with an appropriate pitch on the basis of the journey data, such as the time of the journey, the carrying load, the fuel remaining in the tank, and the like. Nowadays, there are boat propellers with an adjustable pitch. As a result, the boat operators do not have to purchase a variety of boat propellers different in pitch. However, such conventional boat propellers with the adjustable pitch are complicated in construction and operation and are not cost-effective.

SUMMARY OF THE INVENTION

The primary objective of the present invention is to provide a cost-effective boat propeller adjustable in pitch.

It is another objective of the present invention to provide a boat propeller which can be adjusted in pitch in a short notice to meet the requirements of journey.

It is still another objective of the present invention to provide a boat propeller which is simple in construction, cost-effective, and adjustable in pitch easily.

The boat propeller of the present invention comprises a hub, a plurality of angle setting members and blades. The hub is formed of two cylindrical members, which are detachably fastened together in an end-to-end manner and are provided in the junction with a plurality of receiving cavities. The angle setting members are removably disposed in the cavities and are located by a retaining portion which is inserted into the hub. The angle setting members are provided with a connection portion. The blades are mounted around the periphery of the hub such that the inner ends of the blades are inserted into the cavities, and that the inner ends of the blades are located by the connection portions of the angle setting members. The angular relationship between the retaining portions and the connection portions determines indirectly the blade angle in relation to the hub. Various blade angles can be thus provided by the angle setting members of various shapes.

DETAILED DESCRIPTION OF THE INVENTION

Figure 1:
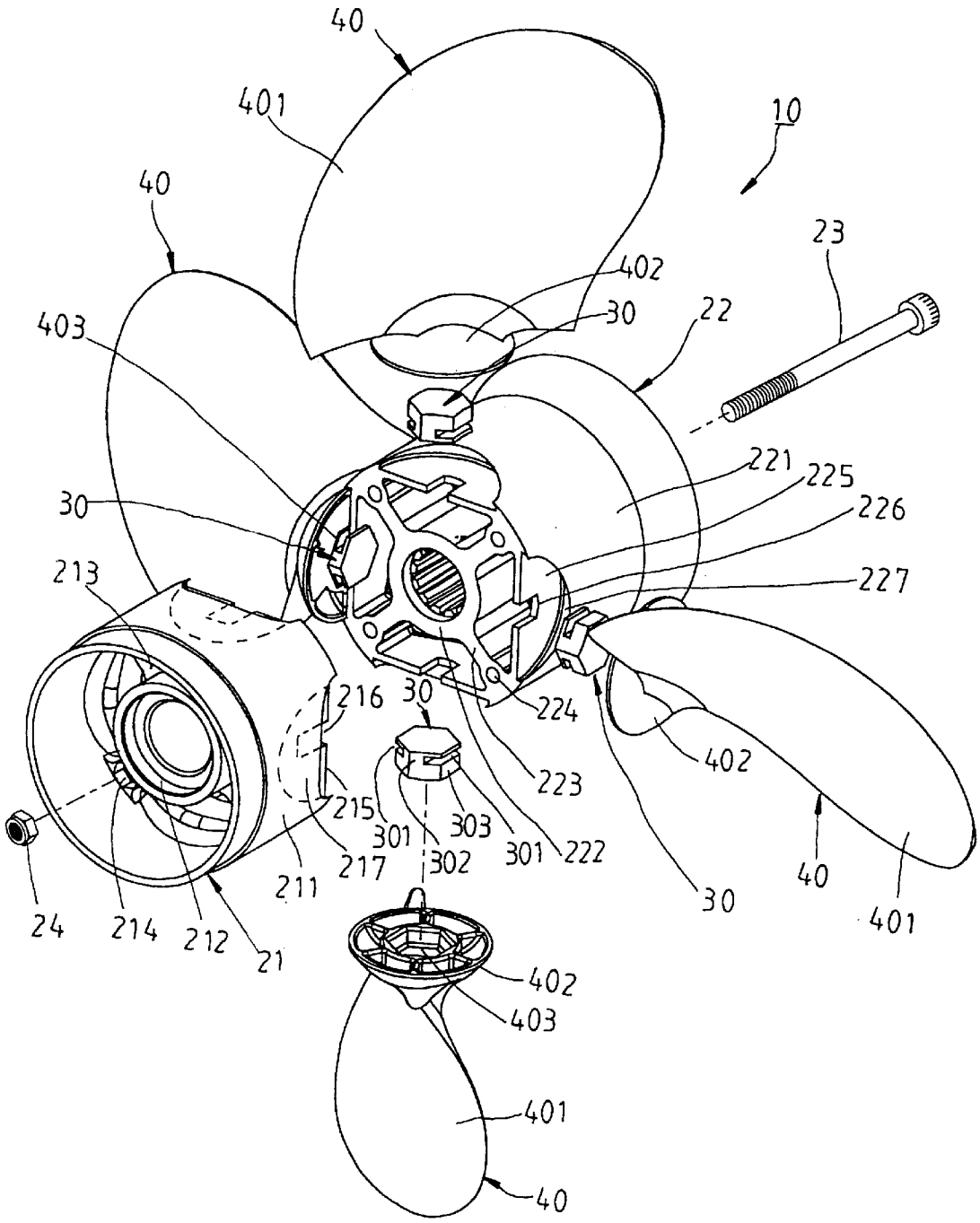
FIG. 1 shows an exploded view of a preferred embodiment of the present invention.
Figure 2:
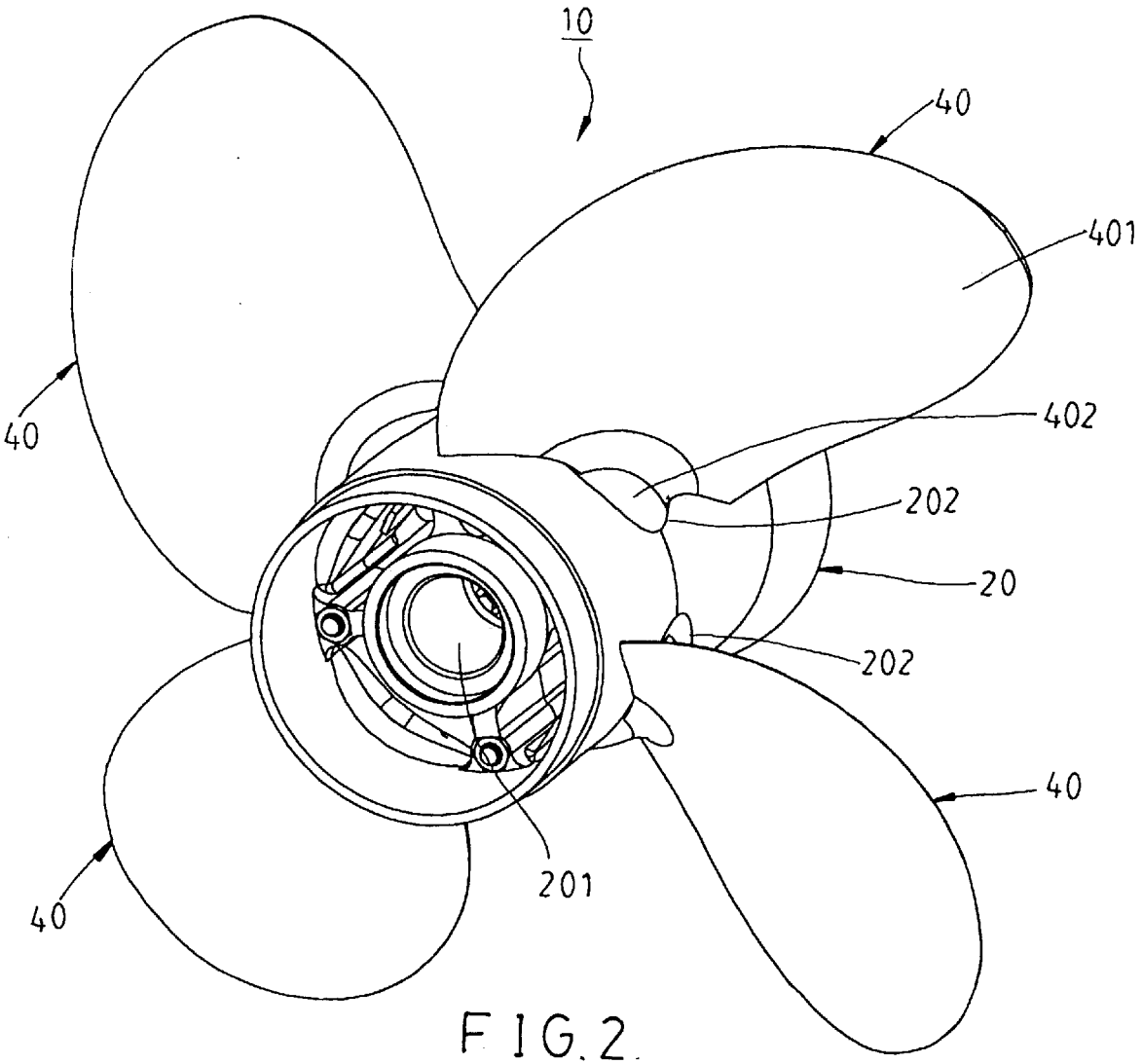
FIG. 2 shows a perspective view of the preferred embodiment of the present invention in combination.
Figure 3:
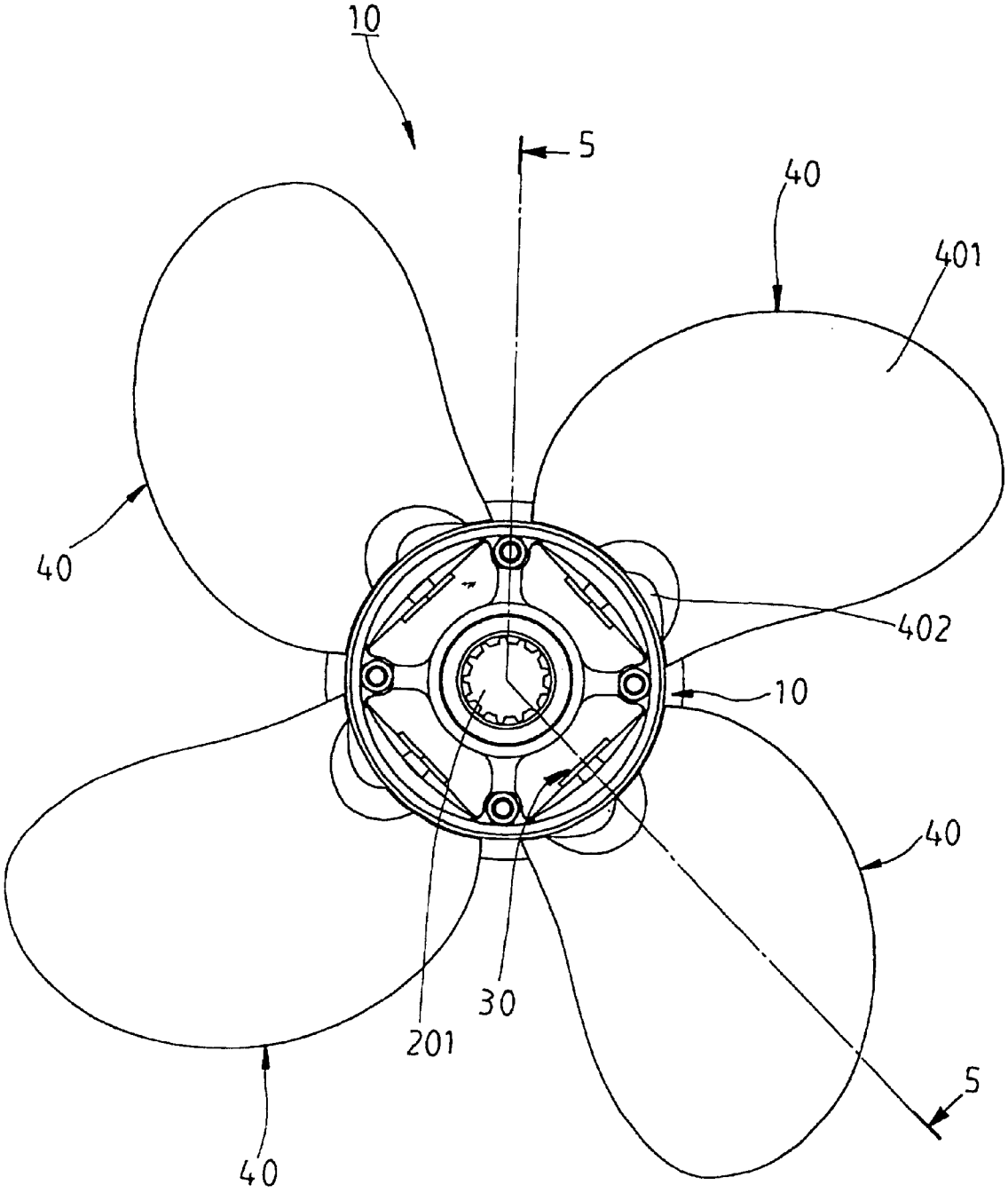
FIG. 3 shows a front view of the preferred embodiment of the present invention.

As shown in FIGS. 1–5, a boat propeller 10 of the preferred embodiment of the present invention comprises the following component parts.

A hub 20 is formed of a front cylindrical member 21 and a rear cylindrical member 22, which are coaxially joined together and are respectively formed of an outer cylindrical body 211, 221, an inner tubular body 212, 222, and a four-armed plate 213, 223 connecting the outer cylindrical body and the inner tubular body. The four-armed plates are provided with an axial through hole 214, 224. The hub 20 is formed of the two cylindrical members 21 and 22, which are fastened together by four long screws 23 and the nuts 24. The screws 23 are put through the through holes 214 and 224. The center of the hub 20 forms a shaft hole 201 for mounting a drive shaft of the motor. The front cylindrical member 21 is provided in the rear edge of the outer periphery thereof with four front side insertion slots 215, which are arranged annularly and equiangularly and are provided with a semicircular bottom having an arcuate front side and a straight rear side, as well as a notch 216 extending forward from the rear edge. The front side insertion slot 215 is provided in the front edge with an arcuate stop edge 217. The rear cylindrical member 22 is provided in the front edge of the outer periphery thereof with four rear side insertion slots 225 which are circularly arranged and are provided with a semicircular bottom having an arcuate side facing rearwards, as well as a notch 226 extending rearwards from the front edge. The rear edge of the rear side insertion slots 225 is provided with an arcuate stop edge 227. Each rear side insertion slot 225 and the corresponding front side insertion slot 215 form together a receiving cavity 202 which is provided with a round bottom with an oval opening. The two notches 216 and 226 of the bottom of the receiving cavity 202 form together a first retaining portion 27.

Four angle setting members 30 are of a hexagonal block-like construction and are provided in the side with two paring cut portions 31 between which a second retaining portion 32 is formed. The second retaining portion 32 is corresponding in size to the first retaining portion 27. The four angle setting members 30 are disposed in the four receiving cavities 202 of the hub 20 such that the second retaining portion 32 is joined with the first retaining portion 27, and that inner and outer ends are retained respectively in the inner and the outer sides of the outer cylindrical bodies 211 and 221 of the hub 20. The portion located in the outer side is provided with a first connection portion 33.

Four blades 40 have a twisted blade piece portion 401 which is connected at the inner end with an insertion portion 402 of a semispherical construction. The round end diameter of the insertion portion 402 is corresponding to the round underside of the receiving cavity 202. The end face is provided with a second connection portion 403 of a hexagonal recessed construction and complementary with the first connection portion 303 of the angle setting members 40.

Figure 5:
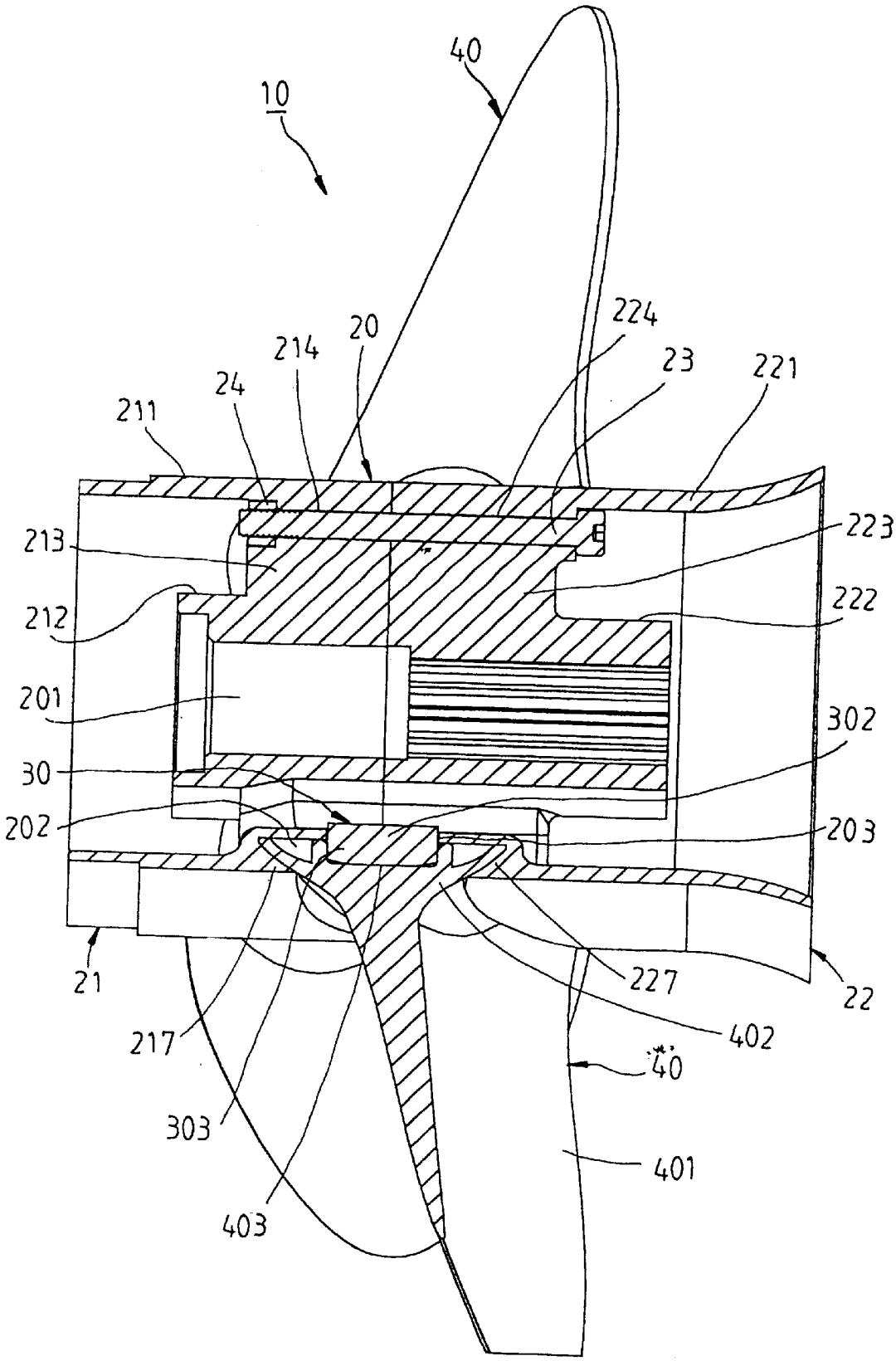
FIG. 5 shows a sectional view taken along a line 5—5 as shown in FIG. 3.

The four mounted annularly and equiangularly in the outer periphery of the hub 20 such that the insertion portion 402 is inserted into the receiving cavity 202, and that the second connection portion 403 is joined with the first connection portion 303 of the angle setting members 30, as shown in FIG. 5.

In short, the boat propeller 10 is formed of the front cylindrical member 21, a rear cylindrical member 22, four angle setting members 30, and four blades 40, which are all joined together detachably. In combination, the second connection portions 403 of the inner ends of the blades 40 are first provided with one angle setting member 30 while the two cylindrical members 21 and 22 are kept separated. Thereafter, the blade portion 401 of the blades 40 is kept at a predetermined inclination before the insertion portion 402 and the angle setting member 30 are inserted axially into the insertion slot 225 of the rear cylindrical member 22, or the insertion slot 215 of the front cylindrical member 21, such that the rear half portion of the insertion portion 402 is inserted into the rear side insertion slot 225, and that the rear half segment of the second retaining portion 302 of the angle setting member 30 is inserted into the notch 226. Upon completion of joining the four blades 40 with the front edge of the rear cylindrical member 22, the front cylindrical member 21 is aligned and joined with the front end of the rear cylindrical member 22 such that the front side insertion slot 215 and the notch 216 are joined together to form the receiving cavity 202 and the first retaining portion 203, thereby securing the insertion portion 402 of the blade 40 and the second retaining portion 302 of the angle setting member 30. Finally, the two cylindrical members 21 and 22 are fastened together by the long screw 23 and the nut 24. The boat propeller 10 is disassembled by detaching first the hub 20 before one of the cylindrical members is detached. Thereafter, the blade 40 and the angle setting member 30 are removed together along the axial direction from the cylindrical member.

Figure 4:
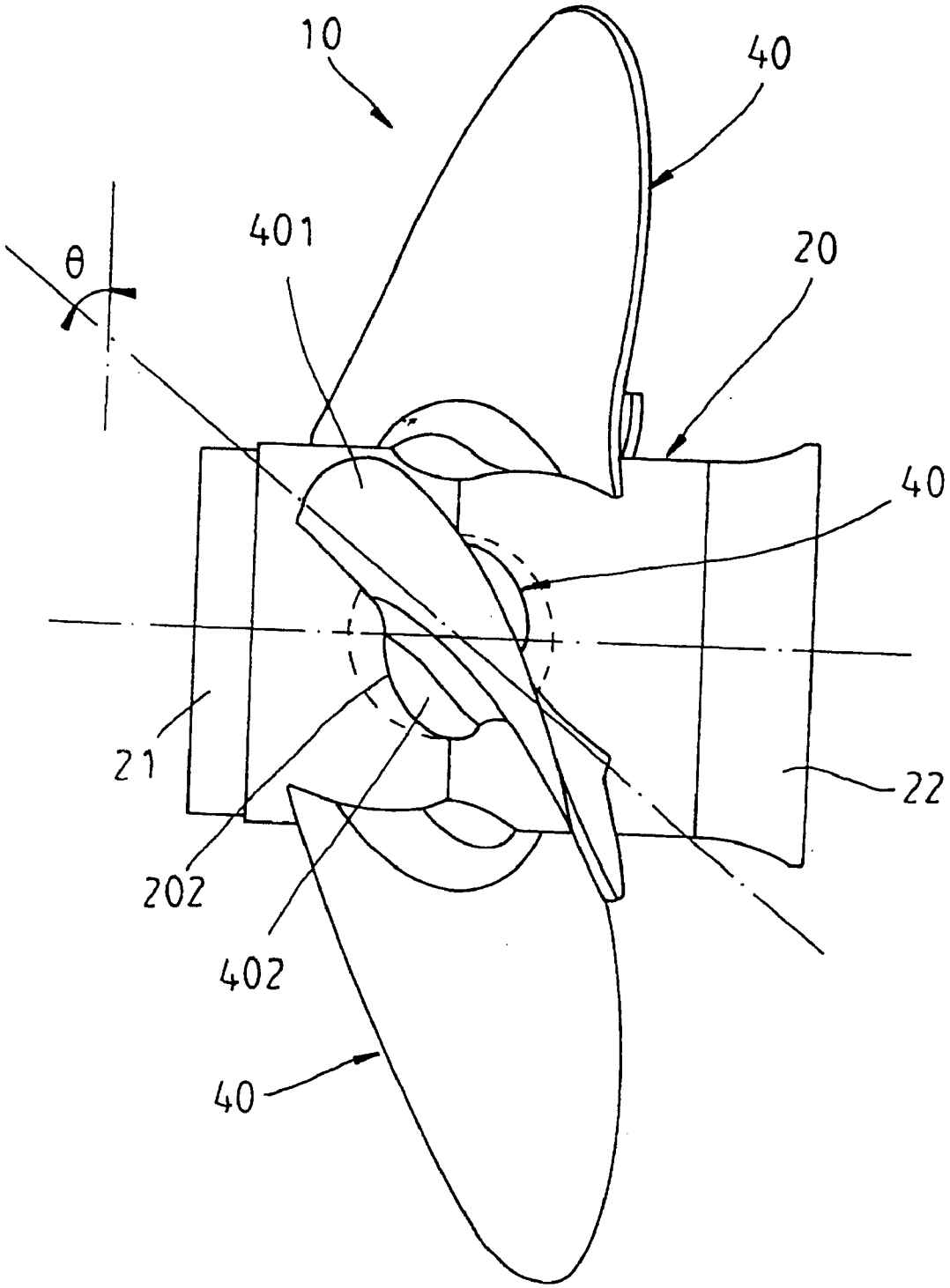
FIG. 4 shows a side view of the preferred embodiment of the present invention.
Figure 6:
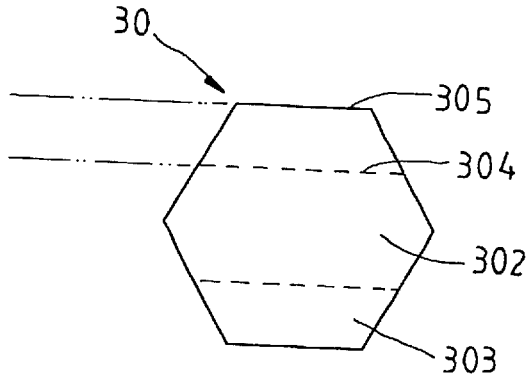
FIGS. 6–8 shows three embodiment patterns of the angle setting members of the preferred embodiment of the present invention.
Figure 7:
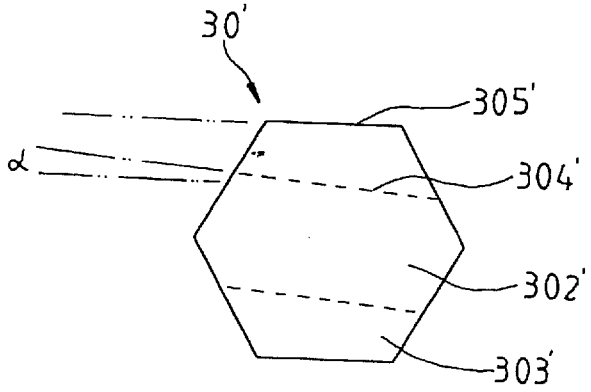
Figure 8:
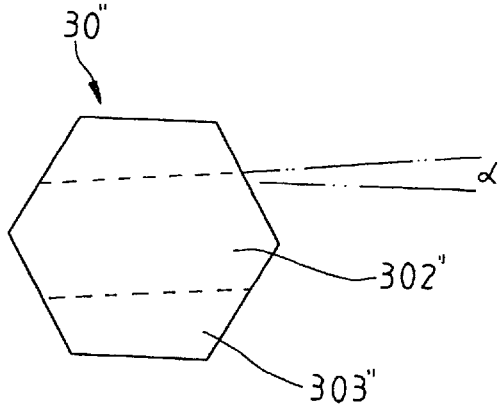

The arcuate stop edges 217 and 227 of the receiving cavities 202 of the hub 20 are intended to confine the insertion portion 402 of the blade 40, so as to enable the inner end of the blade 40 to join securely with the outer periphery of the hub 20, thereby preventing the blade 40 from swaying. The first connection portion 303 and the second connection portion 403 are complementary in shape to each other. In light of the second retaining portion 302 of the angle setting member 30 being retained in the first retaining portion 203 of the hub 20, the angular relationship of the second retaining portion 302 and the first connection portion 303 of the angle setting member 30 determines indirectly the angle of the blade 40 in relation to the hub 20. In other words, under the circumstance that the shapes of the hub 20 and the blades 40 are unchanged, the boat propeller 10 is provided with various pitches by having the angle setting members 30 of various shapes. For example, the shapes of the angle setting members 30 of FIGS. 1–5 are shown in FIG. 6. The two opposite sides 304 of the second retaining portion 302 are parallel to the two sides 305 of the first connection portion 303. A certain point of the blade piece portion 401 of the blade 40 has a pitch $\theta$, as shown in FIG. 4. As shown in FIG. 7, the side 304' of the second retaining portion 302' of the angle setting member 30' is more inclined clockwise by a degrees than the corresponding side 305' of the first connection portion 303'. As the angle setting member 30' is joined with the hub 20, it will turn aside counterclockwise by a degrees than the state as shown in FIG. 4, thereby enabling the insertion portion 402 of the blade 40 to turn aside correspondingly. The pitch of the same constant point of the blade piece portion 401 becomes $\theta+\alpha$. Similarly, the second retaining portion 302" of the angle setting member 30" of FIG. 8 is more counterclockwise turned aside by $\alpha$ degrees than the first connection portion 303". After the assembly, the pitch becomes $\theta-\alpha$.

The makers need to produce only the hubs 20 and the blades 40 of the same specification, and the angle setting members 40 of various shapes. A variety of propellers different in pitch can be thus made at a low cost. The users of the propellers can fit the propellers with the specific angle setting members as desired.

The technique of the present invention is employed in such a way that the angle setting member is detachably installed between the propeller hub and the blades. As a result, various pitches are provided by various angle setting members. The structure for retaining the angle setting member and the hub is not limited to the first retaining portion of the long slot shape, and the blocklike second retaining portion of the angle setting member. For example, the underside of the receiving cavity of the hub may be provided with a dovetail block, whereas the angle setting member is provided in the inner end with a dovetail slot. The first connection portion of the angle setting member is changed to a noncircular slot, whereas the second connection portion of the blade is changed to a protruded pillar of the corresponding shape. The two connection portions are joined together to prevent them from moving aside; they are not necessarily complementary in shape.

What is claimed is:

1. A boat propeller comprising:

a hub formed of a front cylindrical member and a rear cylindrical member which are detachably joined together, said front cylindrical member provided in a rear edge of an outer periphery with a plurality of front side insertion slots arranged equiangularly and circularly, said rear cylindrical member provided in a front edge of an outer periphery with a plurality of rear side insertion slots corresponding to said front side insertion slots, said rear side insertion slot and said front side insertion slot forming a receiving cavity with a wide interior and a narrow opening, said receiving cavity provided in a bottom with a first retaining portion;

a plurality of angle setting members equal in number to said cavities, said angle setting members being detachably disposed in said cavities and provided with a second retaining portion which is retained by said first retaining portion such that said angle setting members are retained at a predetermined angle in relation to said hub, each of said angle setting members having a first connection portion facing outwards; and a plurality of blades equal in number to said cavities and having a blade piece portion and an insertion portion connected with an inner end of said blade piece portion, said blades being circularly disposed in the outer periphery of said hub such that said insertion portions are inserted into said cavities, said insertion portions being provided in an end surface with a second connection portion which is joined with said first connection portion of said angle setting members to enable said blade and said angle setting member to retain at a predetermined angle.

2. The boat propeller as defined in claim 1, wherein said front side insertion slots of said front cylindrical member are provided in the bottom with a notch extending forward from a rear edge; wherein said rear side insertion slots of said rear cylindrical member are provided with a notch extending rearward from a front edge to form along with said notch of said front side insertion slot said first retaining portion; wherein each of said angle setting members is of a polygonal columnar block construction and is provided in a side with two paring cut portions opposite to each other; wherein said second retaining portion is located between said two paring cut portions, said angle setting member being retained at an inner end and an outer end with an inner side and an outer side of said hub, the portion located at said outer side forming said first connection portion; wherein said second connection portion of each of said blades is of a polygonal recessed slot construction.

3. The boat propeller as defined in claim 2, wherein said first connection portion of each of said angle setting members is a hexagonal columnar clock.

4. The boat propeller as defined in claim 1, wherein said front side insertion slots of said front cylindrical member have a bottom of a semicircular shape with an arcuate portion facing forward, said insertion slots being provided in the front edge with an arcuate stop edge; wherein said rear side insertion slots of said rear cylindrical member have a semicircular bottom with an arcuate portion facing rearward, said insertion slots being provided in the rear edge with an arcuate stop edge, thereby enabling the bottom of said cavities to have a round shape and an oval opening; wherein said insertion portion of each of said blades is of a semi-spherical shape.

5. The boat propeller as defined in claim 1, wherein said front cylindrical member and said rear cylindrical member are provided with a plurality of axial through holes opposite to one another, said front cylindrical member and said rear cylindrical member being fastened together to form said hub by a plurality of screws in conjunction with a plurality of nuts, said screws being put through said axial through holes.

* * * * *